US005380406A

United States Patent [19]

Horton et al.

[11] Patent Number: 5,380,406

[45] Date of Patent: Jan. 10, 1995

[54] ELECTROCHEMICAL METHOD OF PRODUCING EUTECTIC URANIUM ALLOY AND APPARATUS

[75] Inventors: James A. Horton, Livermore, Calif.; H. Wayne Hayden, Oakridge, Tenn.

[73] Assignee: The United States of America as represented by the Department of Energy, Washington, D.C.

[21] Appl. No.: 141,754

[22] Filed: Oct. 27, 1993

[51] Int. Cl.[6] ..... C25C 3/00; C25C 3/34

[52] U.S. Cl. ..... 204/1.5; 204/243 R; 204/245; 204/292; 204/294; 423/5; 423/DIG. 12

[58] Field of Search ..... 204/1.5, 294, 243 R, 204/245, 292; 588/201; 423/DIG. 12, 5

[56] References Cited

U.S. PATENT DOCUMENTS

| | | | |
|---|---|---|---|
| H 857 | 12/1990 | Haas | 204/1.5 |
| 4,588,485 | 5/1986 | Cohen et al. | 204/64 R |
| 5,041,193 | 8/1991 | Grantham | 204/1.5 |
| 5,164,050 | 11/1992 | Bertaud et al. | 204/1.5 |
| 5,185,068 | 2/1993 | Sadoway | 204/245 |

OTHER PUBLICATIONS

Kangjo Cho, Junichi Morinaga and Tadashi Kuroda. "Electrolytic Recovery of Metallicd Uranium from U-NB Alloy by Molten Salt Electrolysis," presented at the 36th General Meeting of the Electro-Chemical Society of Japan, Jun. 4, 1969, Tokyo.

Masayoshi Kanno and Sumio Yamagami. "Dissolution of Uranium Metal into Molten LiCl-KCl-UCl," *Denki Kagaku* vol. 43, No. 7, 1975.

D. G. Kesterke, D. C. Fleck, and T. A. Henrie. "Direct Electrolysis of Uranium Dioxide to Uranium Metal in Fluoride Melts." In *Uranium Feed Processing Electrolytic Reduction.* vol. II, Part 2 of 3. Martin Marietta Energy Systems, Inc. Department of Energy.

R. D. Piper, "Production of Uranium Metal from Uranium Oxide by Fused Salt Electrolysis." *Electrochemical Technology.* Mar.-Apr. 1967.

T. A. Henrie, "Electrowinning Rare-Earth and Uranium Metals From Their Oxides." *Journal of Metals.* Dec. 1964.

R. D. Piper and R. F. Leifield. "Electrolytic Reduction of Uranium Oxides to Massive Uranium Metal." In *Process Development Quarterly Progress Report.* AEC Research and Development Report, Mallinckrodt Chemical Works Uranium Division, Nov. 1, 1960.

(List continued on next page.)

*Primary Examiner*—Ngoclan T. Mai

*Attorney, Agent, or Firm*—Miguel A. Valdes; Roger S. Gaither; William R. Moser

[57] ABSTRACT

An apparatus and method for continuous production of liquid uranium alloys through the electrolytic reduction of uranium chlorides. The apparatus includes an electrochemical cell formed from an anode shaped to form an electrolyte reservoir, a cathode comprising a metal, such as iron, capable of forming a eutectic uranium alloy having a melting point less than the melting point of pure uranium, and molten electrolyte in the reservoir comprising a chlorine or fluorine containing salt and uranium chloride. The method of the invention produces an eutectic uranium alloy by creating an electrolyte reservoir defined by a container comprising an anode, placing an electrolyte in the reservoir, the electrolyte comprising a chlorine or fluorine containing salt and uranium chloride in molten form, positioning a cathode in the reservoir where the cathode comprises a metal capable of forming an uranium alloy having a melting point less than the melting point of pure uranium, and applying a current between the cathode and the anode.

18 Claims, 2 Drawing Sheets

OTHER PUBLICATIONS

R. D. Piper and R. F. Leifield. "Electrolytic Reduction of Uranium Oxides." In *Process Development Quarterly Progress Report.* AEC Research and Development Report, Mallinckrode Chemical Works Uranium Division, May 1, 1961.

R. D. Piper. "Electrolytic Reduction of Uranium Oxides." In *Process Development Quarterly Progess Report.* AEC Research and Development Report, Mallinckrodt Chemical Works Uranium Division. Nov. 1, 1961.

R. D. Piper. "Electrolytic Reduction of Uranium Oxides." In *Process Development Quarterly Progress Report.* AEC Research and Development Report, Mallinckrodt Chemical Works Uranium Division. May 1, 1963.

E. C. Gay and R. D. Piper. "Anode Effect in Uranium Electrolytic Cell." In *Process Development Quarterly Progress Report.* AEC Research and Development Report, Mallinckrodt Chemical Works Uranium Division, Nov. 1, 1962.

R. D. Piper. "Electrolytic Reduction of Uranium Oxides." In *Process Development Quarterly Progress Report.* AEC Research and Development Report, Mallinckrodt Chemical Works Uranium Division. May 1, 1962.

Alvin Glassner. "The Thermochemical Properties of the Oxides, Fluorides, and Chlorides to 2500° K." Argone National Laboratory Publication ANL-5750.

ELECTROCHEMICAL METHOD OF PRODUCING EUTECTIC URANIUM ALLOY AND APPARATUS

GOVERNMENT RIGHTS

The United States Government has rights in this invention pursuant to Contract No. W-7405-ENG-48 between the United States Department of Energy and the University of California.

FIELD OF THE INVENTION

The present invention relates to an electrochemical cell and an electrochemical method for producing an eutectic uranium alloy.

BACKGROUND OF THE INVENTION

Laser isotope separation (LIS) enrichment processes are used for producing isotope enriched uranium metal for use as fuel in nuclear reactors. The LIS process requires uranium alloys as feed to the separation process rather than uranium hexafluoride ($UF_6$). Depending on the method used to prepare the uranium feed for the LIS process, the cost of producing the feed can be a significant contributor to the overall costs of the uranium enrichment process.

Currently, uranium feed for LIS processes is produced by the metallothermic reduction of uranium tetrafluoride ($UF_4$) by either the Ames Process or the Elliott Process. The Ames process is a two step batch process for converting $UF_6$ to uranium metal. First, in a continuous process, $UF_6$ is reduced with hydrogen to form $UF_4$. Anhydrous hydrogen fluoride (HF), a valuable by-product, is also produced. The second step involves the batch process conversion of $UF_4$ to uranium metal. This process involves blending $UF_4$ with magnesium metal chips in a graphite or magnesium fluoride lined reaction vessel. The contents of the vessel are then slowly heated for 4 hours to about 540° C. at which point the following reaction occurs over the course of about 2 minutes:

$$UF_4+2\ Mg \rightarrow U+2MgF_2.$$

This reaction is highly exothermic, providing sufficient heat to liquify the products. The liquid uranium that is generated forms droplets that fall through the liquid $MgF_2$ slag to form a mass of uranium metal at the bottom of the vessel.

In order to recover the generated uranium metal, the vessel must first be allowed to cool for several hours. Afterwards, the uranium is separated from the $MgF_2$ by impact methods. Separation of the uranium from the $MgF_2$ slag is incomplete, resulting in a significant loss of the valuable uranium metal product. In addition, the uranium content in the resulting $MgF_2$ slag is sufficiently high so as to require the slag to be disposed as low-level nuclear waste. The $MgF_2$ slag waste generated is many times as voluminous as the uranium metal generated and weighs roughly one-half of the weight of the uranium that is generated. Thus, the Ames method has several significant shortcomings.

Several of the shortcomings of the Ames process are overcome by the Elliott process. The Elliott process is a multistep process involving the reduction of $UF_4$ by magnesium metal. The reduction reaction is conducted in a rotary furnace at a temperature of about 1000° C. wherein the generated solid uranium metal particles are dispersed in solid $MgF_2$. The uranium metal is separated from the $MgF_2$ salt in the second stage of the process wherein the mixed uranium-$MgF_2$ product is mixed with $CaCl_2$ in a reactor at 1150° C. to yield uranium metal and $MgF_2$—$CaCl_2$. The process can be operated continuously by separately removing the uranium metal product and mixed salt by-product.

While more efficient than the Ames process, the Elliott Process has the disadvantages that it requires higher volumes of mixed salt and an additional reheat step to melt the uranium and separate the uranium from the residual salt.

Uranium metal has also been produced electrochemically. Glassner et al. reprocessed spent uranium fuel using a molten KCl—LiCl—$UF_4$ electrolyte bath at 425° C. wherein the solid uranium metal product is deposited on a Mo electrode. Glassner et al., Chemical Engineering Division Summary Reports, ANL-4872, p. 147 (1952). Martin et al. used a KCl—$UCl_3$ electrolyte bath at 900° C. to cause solid purified uranium to deposit on a Mo electrode. F. S. Martin, G. L. Miles, "Process Chemistry"1, p. 329 (1956). Niedrach et al. used a $BaCl_2$—$UF_4$ electrolyte bath with a Ni and Mn electrodes at 975°–1075° C. to prepare purified uranium metal. L. W. Niedrach et al. In. Eng. Chem. 48, 977 (1956); L. W. Niedrach et al., KAPL-1692 (1957); L. W. Niedrach et al., "Process Chemistry" 2, p. 396 (1958). K. Cho et al. prepared solid uranium metal at 600°–750° C. using a $UCl_3$—KCl—NaCl electrolyte bath, an U—Nb alloy electrode and a Mo electrode. K. Cho et al., Denki Kagaku 37 (11) 791–795 (1969). Solid uranium metal was formed on the Mo electrode surface by this process with an electrode current efficiency of 50–90%. Piper (Production of Uranium Metal from Uranium Oxide by Fused Salt Electrolysis, Electrochemical Technology, March–April 1967, pp. 147–151) describes electrolytic processes of the production for molten uranium metal using a $BaF_2$—LiF—$UF_4$ electrolyte.

There have also been some studies in which low melting zinc has been used as a molten electrode to recover the uranium as an intermetallic compound. O. F. Brand et al., A Conf., 15, p. 1780 (1958); Takasi Mukaibo et al., Nippon Gonshiryoku Gakkaishi 7, No. 8, 410 (1965), however, this requires further removal of zinc by evaporation.

Thus, there is a need for a way to produce relatively large quantities of uranium metal in a way that is cost effective yet produces fewer environmentally undesirable side-products. There is a further need for a system which is relatively compact, less costly from a capital standpoint and which can produce a continuous product stream.

SUMMARY OF THE INVENTION

In order to overcome the disadvantages of currently used uranium metal producing technologies, the present invention relates to the continuous production of liquid uranium alloys through the electrolytic reduction of uranium chlorides, $UCl_3$ and $UCl_4$.

An electrochemical cell according to the invention comprises a molten chloride electrolyte, an anode, and a cathode which is comprised of, at least in part, a consumable metal capable of forming an eutectic uranium alloy. In a preferred embodiment a consumable iron cathode is used.

In a further embodiment of the invention, in order to provide a device which has a small "footprint" but which nevertheless has desirable operating characteristics, the anode is shaped to form the inner wall of a permanent carbon cylindrical hole, and a rod-shaped cathode is positioned within that cylinder. In yet a further embodiment of the invention, a number of individual cells are combined to form a highly efficient array for producing uranium metal.

The present invention also relates to a method for producing uranium alloys with a melting point of from about 750°-C. to 1100° C. from $UCl_4$ using an electrochemical cell, where the chloride electrolyte is heated and a current is applied across the consumable cathode to the anode.

BRIEF DESCRIPTION OF THE FIGURES

The invention will be better understood by reference to the appended Figures, of which.

DETAILED DESCRIPTION OF THE INVENTION

Figure 1:
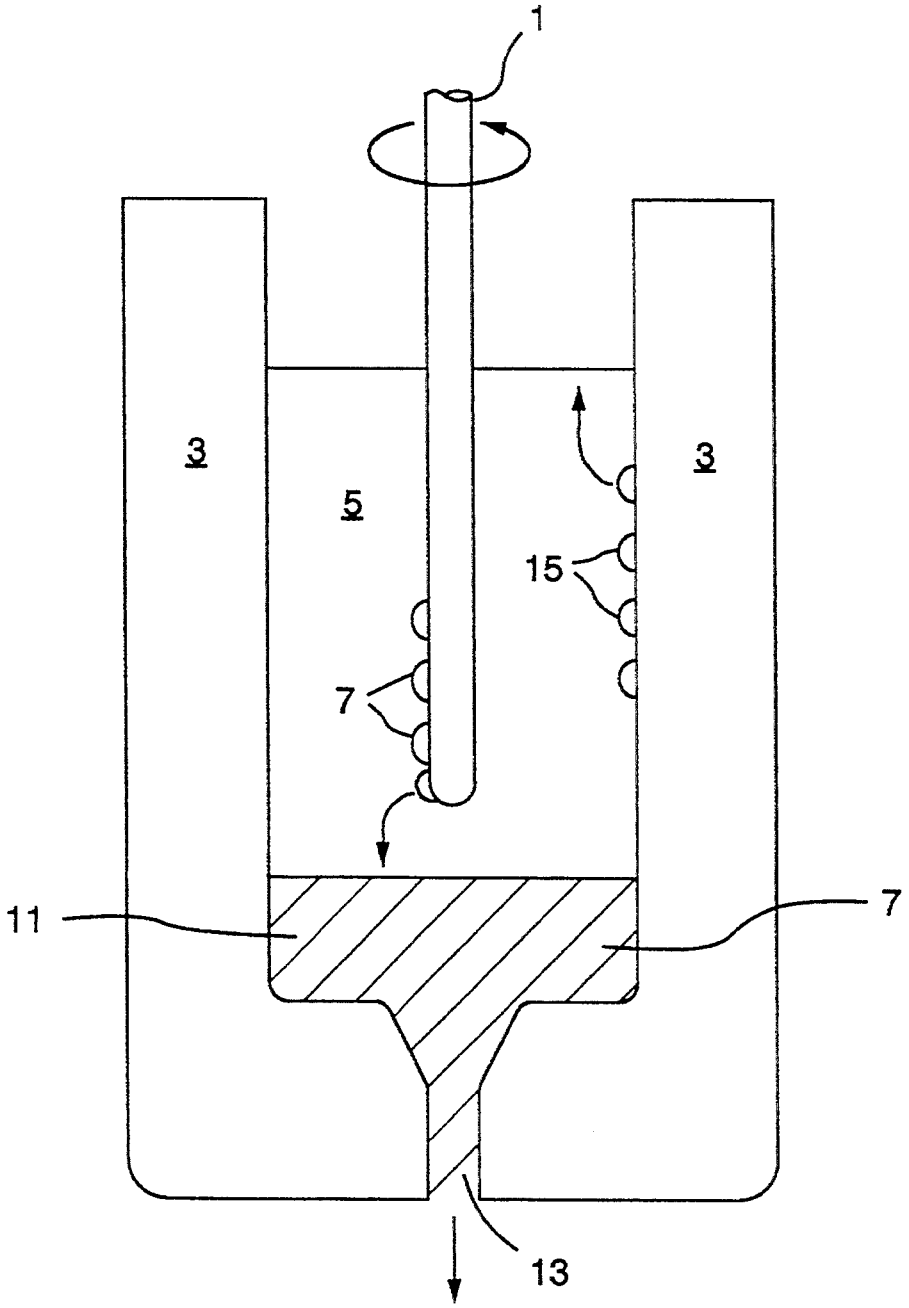
FIG. 1 is a cross-sectional view of an electrochemical cell according to the invention.

The electrochemical cell of the present invention comprises a molten chloride salt electrolyte, a permanent (as opposed to consumable) anode and a cathode comprising, at least in part, a consumable metal that is capable of forming an eutectic uranium alloy from a $UCl_4$ feedstock.

The molten salt electrolyte used in the present invention is comprised of uranium tetra- or tri-chloride combined with other salts which must be thermodynamically more stable than $UCl_3/UCl_4$. Chloride salts are advantageous over other halide salts because they form eutectic salt—$UCl_4$ alloys with melting points as low as 350° C. At temperatures in excess of 800° C., the pure chloride salts are molten. There is unlimited mutual solubility between $UCl_4$ and molten chlorine salts.

Examples of suitable salts for use as the electrolyte of the present invention include chlorine and fluorine containing salts and mixtures thereof which have sufficiently low eutectic melting temperatures. Examples of useful salts include, but are not limited to, $BaCl_2$, $CaCl_2$, CsCl, KCl, LiCl, LiF, $MgCl_2$ and NaCl. The electrolyte of the present invention can also be composed of a combination of two or more stable salts. The most preferred electrolyte of the present invention is a combination of $CaCl_2$ and $UCl_4$.

The concentration of $UCl_4$ relative to the molten salt electrolyte is preferably in the range of approximately 1 to 10% by weight of the total mixture.

It has been found that the amount of electrical energy consumed by the electrochemical cell can be minimized by balancing two contrary trends regarding changes in the $UCl_4$ content of the molten chloride salt electrolyte. As the content of $UCl_4$ in the electrolyte increases, the electrical resistivity of the electrolyte increases thus leading to a voltage drop across a fixed spacing between the anode and cathode at a fixed current level. However, as the $UCl_4$ concentration increases, the back EMF required for uranium reduction decreases. The total anode to cathode voltage drop is the resistive voltage drop and the back EMF. Based on these observed phenomenon, it has been determined that the total voltage requirement of the cell can be minimized by operating the cell at an intermediate level of dissolved uranium.

The anode of the electrochemical cell of the present invention is composed of a material highly resistant to chemical and erosive attack under the conditions discussed herein. A solid block of carbon, such as is well known in the art, is the preferred material for use as the anode.

The consumable cathode of the present invention is comprised of, in whole or in part, a metal capable of forming an uranium alloy with a melting point less than that of pure uranium. Examples of suitable cathode metals include, but are not limited to, Fe, Cr, Mn, Co, Ni, Ru, Rh, Pd, Os, Ir, Pt, Al, Au, Cd, Cu, Pb, Sn and Zn. Iron and nickel are the preferred metals for use as the consumable component of the cathode.

During the operation of the cell the $UCl_4$—molten chloride mixture is maintained at a temperature from about 750° C. to 1100° C. The lower limit of this range is determined by the melting point of the $UCl_4$, approximately 700° C. On the other hand, the melting point of uranium metal is about 1132° C. The melting point of the eutectic of uranium and iron which forms at the surface of the cathode during the process of the invention can be as low as about 725° C.

The structure of the cell of the invention, and the materials used, allow for the use of very high current densities at the cathode surface of about 150 amps/$cm^2$. As current is increased the electrochemical conversion of chlorine at the anode surface becomes more and more vigorous. As a practical limit, under atmospheric conditions, the current will be limited to a level such that the rate at which $Cl_2$ gas is produced does not inhibit the electrolyte from reaching the anode. It is possible that the cell could be run under higher than atmospheric pressures to avoid this limitation, however.

The minimum cell voltage is determined by the voltage necessary to achieve dissociation of the chlorine from the uranium, plus the voltage drop across the electrolyte, and the impedance drop for uranium eutectic plating out (as a liquid) at the cathode surface.

During the reduction of $UCl_4$ to uranium metal, $Cl_2$ gas which is evolved can be collected and recycled for use in the conversion of $UO_2$ to $UCl_4$, the $UCl_4$ being the feed to the electrochemical method of the instant invention.

Figure 2:
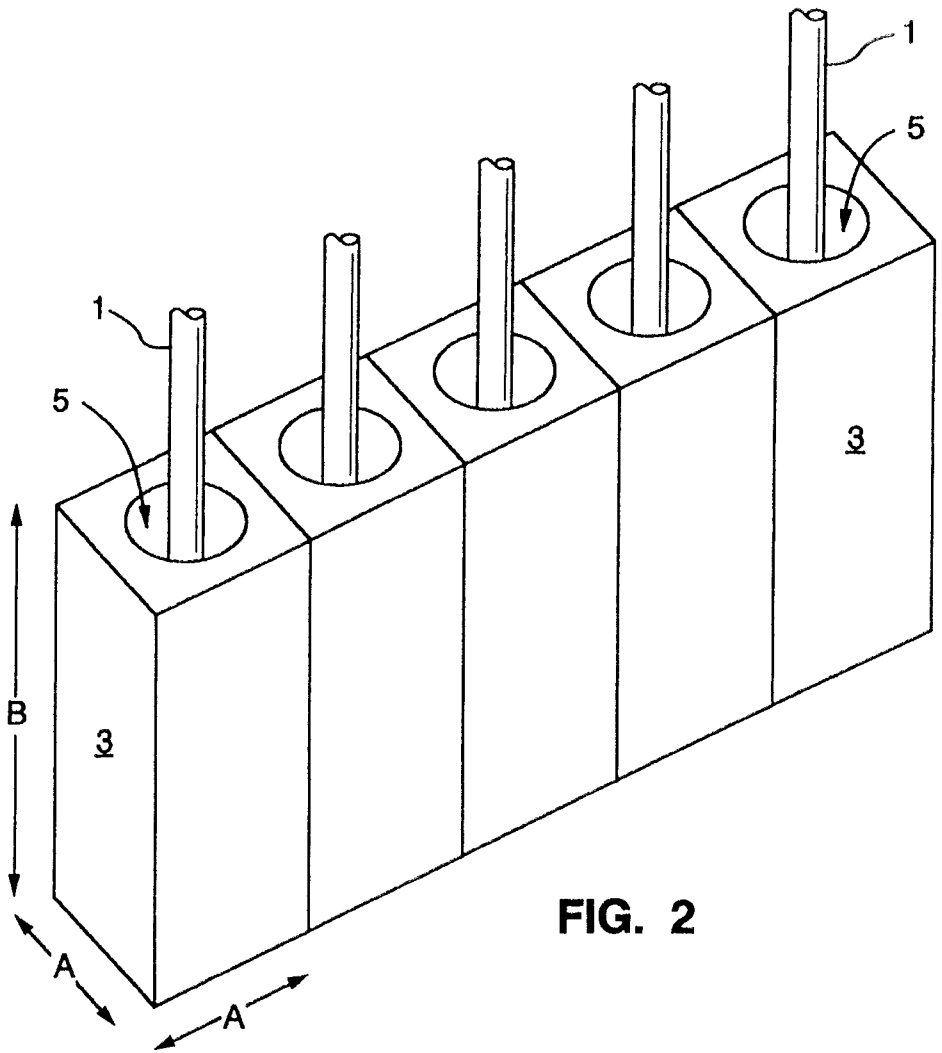
FIG. 2 is a perspective view of an array of cells of the type shown in FIG. 1.

FIG. 1 depicts the preferred embodiment of the electrochemical cell of the present invention. FIG. 2 is a perspective view of an array of cells of the type shown in cross section in FIG. 1. In FIG. 1 the cell comprises a consumable cathode 1 and a surrounding anode block 3, preferably formed from carbon. The volume surrounding the cathode within the anode is filled with molten salt electrolyte 5. Uranium metal alloy 7 is plated out on the surface of cathode 1. Since the metal alloy has a higher density than the electrolyte, alloy 7 sinks to the bottom of the cell to form a pool 11. A port 13 in the bottom of anode block 3 is used to drain the molten metal product from the cell. Gas bubbles 15 are formed at the cylindrically shaped anode surface.

It has been observed that small anode to cathode diameter ratios result in increased cell current efficiencies. The sizing of the anode cavity diameter to the cathode diameter can be set to ensure efficient electrochemical operation as well as complete consumption of the consumable metal cathode. Small anode to cathode surface area ratios also enable a higher percentage recovery of the $Cl_2$ gas generated during $UCl_4$ reduction.

The vertically disposed cylindrical shape of the cell is particularly advantageous for the present invention.

Gas formed at the anode surface quickly moves through the electrolyte to the surface to be collected for recycle. Likewise, metal formed at the surface of the cathode can be drained through the lower port to allow for continuous operation of the cell. The rod-shaped cathode can be rotated within the cell and can be raised and lowered to facilitate use as the cathode is consumed, and later replacement. The cathode portion above the liquid electrolyte surface may be protected from exiting chlorine gas by an aluminum sheath (not shown).

To facilitate continuous operation, a series of the cells of the invention can be used as shown in FIG. 2. FIG. 2 shows an array of five cells, each of which includes a cathode 1 and an anode block 3. A typical cell would measure eight inches in dimension "A" and twenty four inches in dimension "B." The cathode is rod-shaped and is two inches in diameter. The electrolyte reservoir is cylindrically shaped and six inches in diameter. Alloy produced in the series of cells is drained through an opening in the bottom of each cell and can be collected continuously. Typically, the cell will operate at current densities of about up to four amp/cm$^2$ at the anode through higher densities are possible. The tip of the cathode rod may be tapered to ensure that the field focusses at the lower end, and the cathode consumed most quickly there.

The system of the invention can be optimized not only by specifying the geometry of individual cells, but by combining cells as required for the quantity of product required at a particular location. To facilitate maintenance of the cells, another array of cells (not shown) can be used in parallel with the array of FIG. 2, so that one of the arrays could be taken off-line without interrupting production.

While the present invention has been disclosed by reference to the details of preferred embodiments, it is to be understood that this disclosure is illustrative rather than limiting, as it is contemplated that modifications will readily occur to those skilled in the art, within the spirit of the invention and the scope of the appended claims.

What is claimed is:

1. An electrochemical method of producing an eutectic uranium alloy comprising the steps of:

(a) creating an electrolyte reservoir defined by a container comprising an anode;

(b) placing an electrolyte mixture in said reservoir and in contact with said anode, said electrolyte comprising a chlorine or fluorine containing salt and uranium chloride, and melting said mixture;

(c) positioning a cathode in said reservoir, and in contact with said electrolyte, said cathode comprising a metal capable of forming an uranium alloy having a melting point less than the melting point of pure uranium; and (d) applying a current between said cathode to said anode so that the uranium alloy forms on said cathode.

2. The method of claim 1 wherein said metal is selected from the group consisting of: Fe, Cr, Mn, Co, Ni, Ru, Rh, Pd, Os, Ir, Pt, Al, Au, Cd, Cu, Pb, Sn, and Zn.

3. The method of claim 1 wherein said metal is Fe.

4. The method of claim 1 wherein said salt is selected from the group consisting of $BaCl_2$, $CaCl_2$, CsCl, KCl, LiCl, $MgCl_2$, LiF and NaCl.

5. The method of claim 1 wherein said salt is $CaCl_2$.

6. The method of claim 1 wherein said anode is comprised of carbon.

7. An electrochemical method of producing an eutectic uranium alloy comprising the steps of:

(a) creating an electrolyte reservoir defined by a container comprising an anode;

(b) placing an electrolyte mixture in said reservoir and in contact with said anode, said electrolyte comprising a chlorine or fluorine containing salt and uranium chloride, and melting said mixture;

(c) positioning a cathode in said reservoir, and in contact with said electrolyte, said cathode comprising a metal capable of forming an uranium alloy having a melting point less than the melting point of pure uranium;

(d) applying a current between said cathode to said anode; and (e) draining molten uranium alloy from said reservoir.

8. The method of claim 1 comprising the additional steps of:

(a) forming $Cl_2$ gas at said anode; and (b) collecting the formed $Cl_2$ gas.

9. The method of claim 1 wherein said mixture comprises from about 1 to about 10% by weight $UCl_4$.

10. An electrochemical cell for producing an eutectic uranium alloy from $UCl_4$ comprising:

an anode shaped to form an electrolyte reservoir;

a cathode comprising a metal capable of forming an eutectic uranium alloy having a melting point less than the melting point of pure uranium; and a molten electrolyte in said reservoir and in contact with said anode and said cathode, said electrolyte comprising a chlorine or fluorine containing salt and uranium chloride.

11. The electrochemical cell of claim 10 wherein said anode defines a cylindrically shaped reservoir.

12. The electrochemical cell of claim 11 wherein the cathode is rod shaped.

13. The electrochemical cell of claim 10 wherein said metal is selected from the group consisting of: Fe, Cr, Mn, Co, Ni, Ru, Rh, Pd, Os, Ir, Pt, Al, Au, Cd, Cu, Pb, Sn, and Zn.

14. The electrochemical cell of claim 10 wherein said salt is selected from the group consisting of $BaCl_2$, $CaCl_2$, CsCl, KCl, LiCl, $MgCl_2$, Lif and NaCl.

15. The electrochemical cell of claim 10 wherein said salt is $CaCl_2$.

16. The electrochemical cell of claim 10 wherein said anode is comprised of carbon.

17. The electrochemical cell of claim 10 wherein said mixture comprises from about 1 to about 10% by weight $UCl_4$.

18. The electrochemical cell of claim 11 wherein said reservoir includes an opening in the bottom thereof for draining the eutectic alloy produced in the cell during use.

* * * * *